United States Patent [19]

Bouchez et al.

[11] Patent Number: 4,941,749

[45] Date of Patent: Jul. 17, 1990

[54] HUB FOR AN AGITATOR HAVING HOLLOW BLADES AND AN INTERNAL HEAT-CONVEYING FLUID FLOW CIRCUIT

[75] Inventors: Alain Bouchez, Vincennes; Patrice Cognard, Boulogne; Gérard Marie, Rueil Malmaison; Alain Schmidt, Mesnil le Roy, all of France

[73] Assignee: Societe Anonyme: Moritz, France

[21] Appl. No.: 289,664

[22] Filed: Dec. 27, 1988

[30] Foreign Application Priority Data

Dec. 29, 1987 [FR] France ..... 87 18510

[51] Int. Cl.[5] ..... B01F 7/20; B01F 15/06; F28F 5/04

[52] U.S. Cl. ..... 366/147; 165/92; 366/169; 366/314; 366/325

[58] Field of Search ..... 366/270, 147, 167, 168, 366/169, 170, 330, 331, 343, 314, 325; 165/86, 92, 87, 88, 109.1; 416/90 R, 90 A, 92, 232, 233, 238, 239, 248; 422/135, 225, 226

[56] References Cited

U.S. PATENT DOCUMENTS

| | | | |
|---|---|---|---|
| 664,776 | 12/1900 | Porter | 165/92 X |
| 758,045 | 4/1904 | Braselmann et al. | 165/92 |
| 1,415,433 | 5/1922 | Engel | 165/92 X |
| 1,478,222 | 12/1923 | Hansen | 366/167 X |
| 2,151,791 | 3/1939 | Muren | 165/87 |
| 3,241,606 | 3/1966 | Honjo et al. | 165/86 |
| 3,285,331 | 11/1966 | Bratland | 366/270 X |
| 3,387,651 | 6/1968 | Berker | 165/109.1 |
| 3,554,274 | 1/1971 | Herfeld | 165/92 X |
| 3,884,294 | 5/1975 | Lodige et al. | 165/92 |
| 4,722,608 | 2/1988 | Salzman et al. | 366/330 |
| 4,729,878 | 3/1988 | Pommier et al. | 366/330 X |

FOREIGN PATENT DOCUMENTS

| | | | |
|---|---|---|---|
| 74037 | 11/1917 | Austria | 366/169 |
| 568738 | 1/1959 | Canada | 366/330 |
| 192515 | 12/1907 | Fed. Rep. of Germany | 165/92 |
| 76013 | 4/1919 | Fed. Rep. of Germany | 366/343 |
| 1926704 | 11/1970 | Fed. Rep. of Germany . | |
| 1010591 | 6/1952 | France | 366/343 |
| 1460908 | 10/1965 | France . | |
| 643153 | 5/1965 | Switzerland . | |
| 1215057 | 12/1970 | United Kingdom | 366/331 |

*Primary Examiner*—Harvey C. Hornsby
*Assistant Examiner*—Scott J. Haugland
*Attorney, Agent, or Firm*—Bacon & Thomas

[57] ABSTRACT

In apparatus for mixing or kneading various substances, hollow blades are connected to an agitator hub of the invention which comprises:

a fluted ring (9) threaded over the shaft (11) and carrying the roots (20) of hollow blades (2);

an axial fastening liner (12) interposed between the shaft and the ring and held axially in position by a stopper; and at least one fluid flow circuit passing through the shaft and the ring and opening out into the blades.

The invention is applicable to controlling the reaction of chemical compounds.

10 Claims, 4 Drawing Sheets

HUB FOR AN AGITATOR HAVING HOLLOW BLADES AND AN INTERNAL HEAT-CONVEYING FLUID FLOW CIRCUIT

The present invention relates to apparatuses for kneading, mixing, or homogenizing, as are used in numerous industrial fields for making up various products, or also for ensuring that certain chemical reactions are properly performed, or finally for conditioning intermediate products or end products.

BACKGROUND OF THE INVENTION

Such apparatuses comprise a vat or receptacle which is generally substantially cylindrical or substantially spherical in shape and which contains an agitating moving member fitted to the outlet shaft of a motor and stepdown gear unit providing rotary drive. The agitating moving member is constituted by a hub from which there project a plurality of blades or vanes of a shape which is selected as a function of the nature of the products and of the work or treatment to be performed, so that uniform mixing can be effectively sustained throughout the bulk of the products contained in the receptacle.

In order to illustrate the prior art on this topic, reference may be made to the teaching of French patents numbered 2 052 018 (69/22 862) and 2 273 582 (74/19 418).

Although the agitating moving members known at present generally give satisfaction with respect to uniformity and thorough mixing of the products contained in the receptacle, it turns out that such apparatuses, taken as a whole, are not suitable in all cases for properly performing the operations of mixing, homogenizing, stirring, or treatment.

Depending on the processes that are to be performed, it often happens that proper operation requires heat to be added to or taken from the mixture in order to maintain a core temperature which is compatible with the mixing, homogenizing, or processing to be performed. It also often happens that a need arises to act on thermal parameters in temporary manner, for example during a reaction stage, with the agitating moving member being required at other times merely to maintain stirring.

In the past, such a thermal parameter has been adequately controlled by means of heat-conveying fluids flowing inside a double-walled vessel. Heat exchange takes place by conduction through the wall of the vessel which constitutes a barrier impeding heat exchange. Under such conditions it becomes difficult to inject or remove heat to or from the core of the moving mass inside the vat or the receptacle, or else to or from the vicinity of the agitating moving member.

In order to remedy this drawback, proposals have been made, e.g. in French patent number 1 460 908, to provide blades or vanes of an agitating module which are hollow, so as to delimit an internal go-and-return circuit for a heat-conveying fluid.

Using such technical means, it is possible to add or subtract heat to or from the moving mass and be certain that heat transmission actually takes place, given that the various blades of the agitating module are permanently in contact with the core of the mass to be stirred or mixed.

Although such a proposition solves the problem posed, it suffers from posing a secondary problem, namely the problem of providing a suitable hub capable of being fitted to the drive shaft and of withstanding a high level of mechanical loading due to its transmission of the drive torque provided by the driving system used.

Such a hub must also be suitable for providing the go-and-return flow of the heat-conveying fluid between the blades or vanes and a go-and-return circuit connected to the drive shaft of such an agitating module. Such fluid transmission must naturally be provided in fluid-tight manner.

Another requirement of such a hub lies in the need for it to provide easy and quick access to its various component parts when a leak needs to be repaired or when a blade needs to be replaced, e.g. because it has been damaged, at least in part.

These requirements are not solved by above-mentioned French patent number 1 460 908, nor by the teaching of the following patent publications No.: DE 19 26 704, U.S. Pat. No. 3 241 606, and CH 643 153, none of which pays particular attention to the specific problem of how the blade hub should be constituted.

An object of the invention is to satisfy these difficulties taken as a whole.

SUMMARY OF THE INVENTION

To this end, the present invention provides a hub for an agitator having hollow blades and an internal fluid flow circuit, the hub being of the type intended for mounting at the end of a fluted drive shaft which is connected to at least one fluid flow circuit, the hub comprising:

a fluted ring threaded over the shaft and carrying the roots of hollow blades;

an axial fastening liner interposed between the shaft and the ring and held axially in position by a stopper: and at least one fluid flow circuit passing through the shaft and the ring and opening out into the blades.

The invention also provides an agitator hub suitable for establishing optimum flow conditions for a heat-conveying fluid so as to enable heat exchange to take place in reliable and continuous manner for a given known speed or rate of flow of a given fluid and on the basis of each blade acting as a heat exchanger, per se.

The invention also provides an agitator moving member of the type having hollow blades with an internal fluid flow circuit for a heat-conveying fluid, where the hub implements the characteristics of the invention.

BRIEF DESCRIPTION OF THE DRAWINGS

An embodiment of the invention is described by way of example with reference to the accompanying drawings, in which.

MORE DETAILED DESCRIPTION

Figure 1:
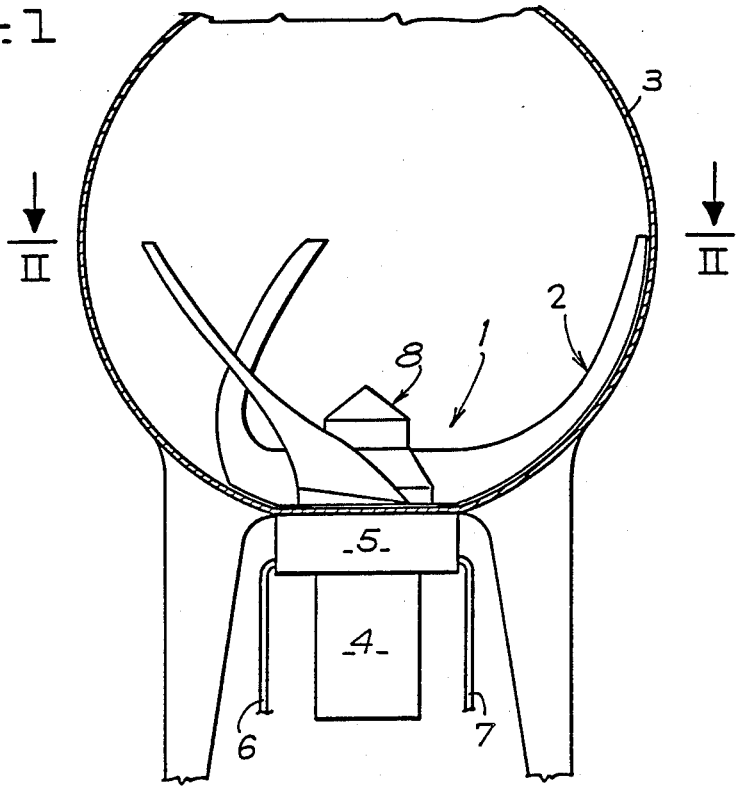
FIG. 1 is a diagrammatic elevation view in section through apparatus for kneading, mixing, or stirring, and including an agitating moving member in accordance with the invention.
Figure 2:
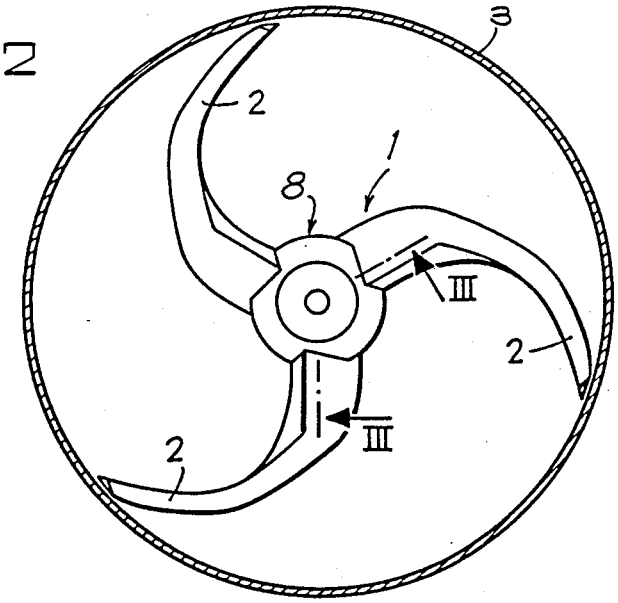
FIG. 2 is a plan view lying substantially on line II—II of FIG. 1.

The subject matter of the invention is constituted by the hub of an agitating moving member 1, as represented in FIGS. 1 and 2 by a structure comprising three blades or vanes 2. The agitating moving member 1 is intended to be mounted inside a vat or receptacle 3 which is generally spherical in shape, for example, and which has an open top portion (not shown in FIG. 1) which is closed by any suitable closure means suitable for facilitating possible loading and unloading of the receptacle. The stirring moving member 1 is supported in the vicinity of the bottom of the vat or receptacle 3 by being carried on the outlet shaft of a motor and stepdown gear unit 4.

The hub of the invention is provided to assume the function of fitting the stirring moving member onto the outlet shaft of the motor and stepdown gear unit 4, together with the additional function of providing fluid interconnection with a feed module 5 connected to a go circuit 6 and a return circuit 7 for circulating a heat-conveying fluid inside the various blades or vanes 2.

Figure 3:
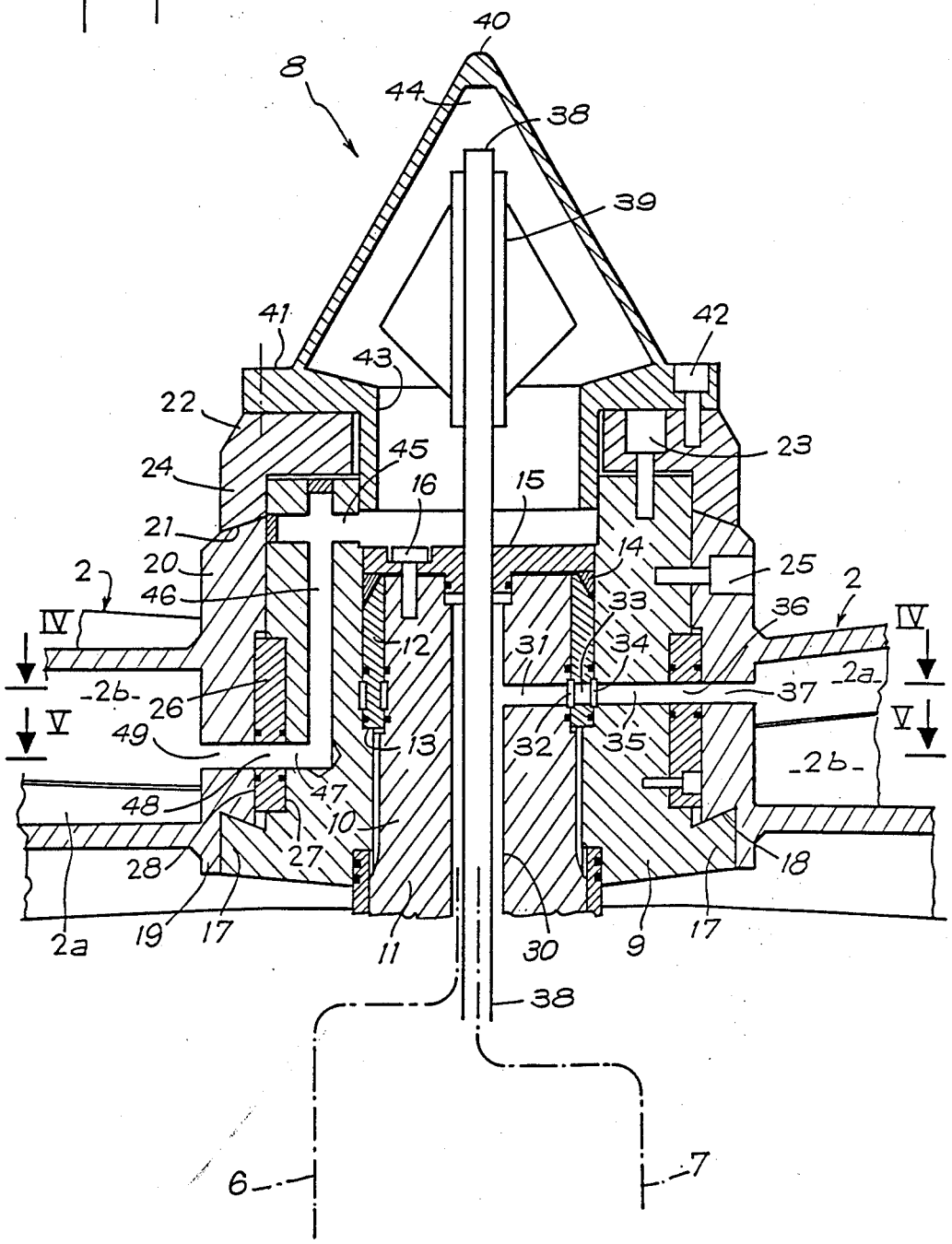
FIG. 3 is an elevation view in section on broken dot-dashed line III—III of FIG. 2.
Figure 4:
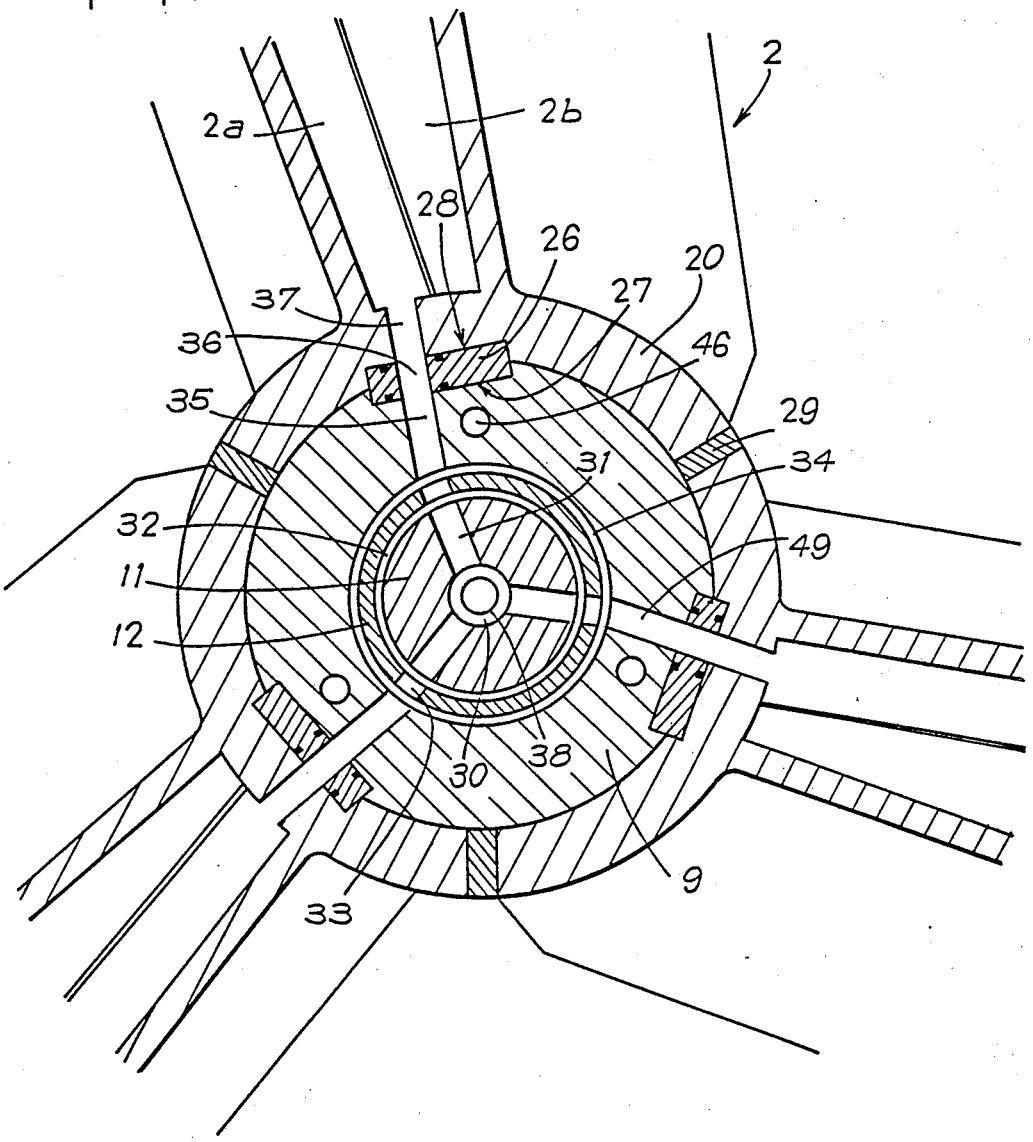
FIGS. 4 and 5 are cross-sections respectively on lines IV—IV and V—V of FIG. 3.
Figure 5:
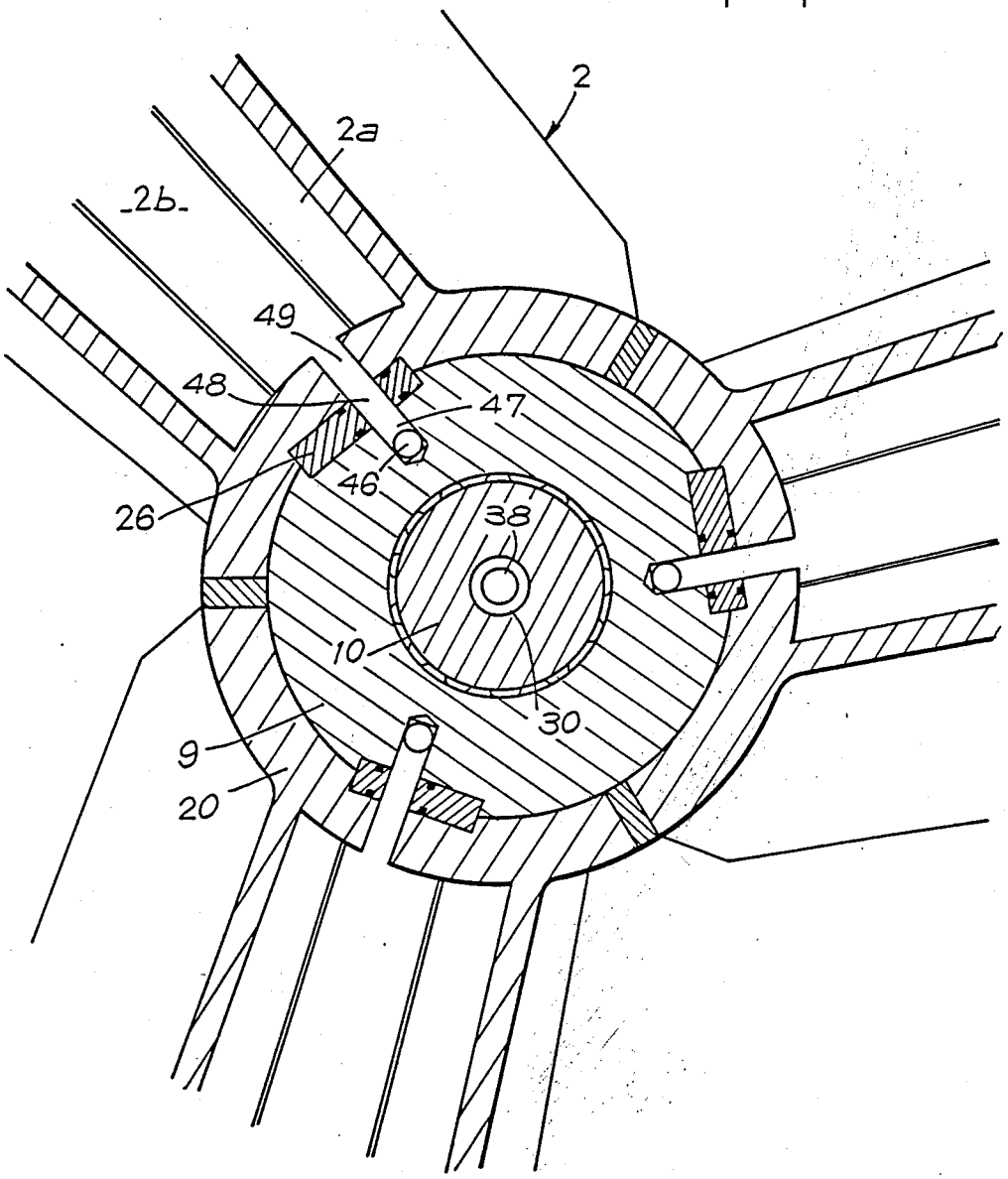

In order to provide both of the above-specified functions, while still having high mechanical strength suitable for withstanding the stresses developed by the work performed by the blades or vanes 2 and by the torque which is transmitted from the motor and stepdown gear unit 4, while nevertheless remaining suitable for being put into place rapidly and for easy maintenance, the hub of the agitating member is made as shown in FIGS. 3 and 4.

The hub is designated over all by reference 8, and comprises a ring 9 for mounting on the fluted terminal portion 10 of the outlet shaft 11 from the motor and stepdown gear unit 4. The ring 9 is held in place axially on said end portion 10 by means of an axial locking liner 12 disposed between the terminal portion 10 and the ring 9. The liner 12 is pressed axially against a shoulder 13 of the ring 9 by a wedge-section segment 14 under axial thrust from an axial locking stopper 15 which is put into place and fixed by means of a screw 16 engaging the terminal portion 10.

The ring 9 is intended to support blades 2, and to this end its base forms a collar 17 defining an undercut bearing surface 18. The bearing surface 18 is intended to co-operate with the reentrant bottom edges 19 at the blade roots 20, with there being three blades, for example, as shown in FIG. 2. It should be understood that some other number of blades could be provided without going beyond the scope of the invention Each blade root 20 is in the form of a sector of a circle having a dove-tail shape in axial section relative to the hub and partially delimited by the reentrant bottom edge 19 and by a top edge 21. Each blade root 20 is fitted to the outside periphery of the ring 9 in such a manner that its reentrant bottom edge 19 engages the collar 17 by co-operating with the undercut bearing surface 18.

The blade roots 20 are fixed axially by a flange 22 mounted by means of screws 23 onto the transverse end of the ring 9 extending above the stopper 15. The flange 22 is of the annular type and forms or includes a peripheral rim 24 which is under-cut and which engages the top edges 21 of the various blade roots 20.

Each blade root 20 is fixed radially by the combination of the rim 24 and the screws 25 which extend transversely through the ring 9.

In addition, each blade root 20 is fixed angularly on the ring 9 by means of a key 26 disposed in two complementary housings 27 and 28 presented in the facing faces of the ring 9 and of the blade root 20.

The above means provide quick, practical, and strong assembly for each blade 2 which can be quickly and easily dismantled from the ring 9. The fixing means used are also suitable for providing particularly high mechanical strength to the assembly of a blade root 20 with the ring 9, given that each of them is fixed in three separate directions.

In order to limit the inwardly or outwardly directed angular portions of the hub which could disturb operation of the agitator within the mixture, the blade roots 20 are preferably provided with strips 29 for ensuring that the blade root 20 together with the strips 29 build up a continuous envelope around the ring 9. The strips 29 are held in place between the under-cut bearing surface 18 and the rim 24.

As mentioned above, a hub in accordance with the invention is intended to provide a first function of physically holding the blades 2 in a mechanically strong manner, and a second function of interconnecting the circuits 6 and 7 with the channels or compartments **2*a* and 2*b* delimited inside each of the blades 2**. To this end, the inside of the hub includes fluid-tight circulation means for providing this interconnection function.

The fluid-tight flow means comprise firstly an axial bore 30 along the shaft 11 for connection to the go circuit 6. The bore 30 runs from the end of the terminal portion 10 and is closed in sealed manner by means of the stopper 15.

The fluid-tight flow means interconnecting with the go circuit 6 also includes, for each blade 2, a substantially radial duct 31 going through the terminal portion 10 in order to cause the bore 30 to communicate with a distribution chamber 32 provided by grooves formed in the facing faces of the terminal portion 10 and of the liner 12. Each duct 31 coincides with an opening 33 through the liner 12 and opening out into a second distribution chamber 34 delimited by grooves formed in the facing faces of the liner 12 and of the ring 9. The opening 33 coincides with a hole 35 formed substantially radially through the ring 9. The hole 35 coincides with an opening 36 provided in the key 26. The opening 36 coincides with a passage 37 provided through the blade root 20 and opening out into the first channel or compartment **2*a* provided therein. In conventional manner, the channel or compartment 2*a* communicates, for example, with the second passage 2*b***, at the far end of the blade.

Sealing means are provided in the form, for example, of toroidal or lipped rings or gaskets, e.g. placed at the interfaces between the terminal portion 10 and the liner 12, between the liner 12 and the ring 9, between the ring 9 and the key 26, and between the key 26 and the blade root 20.

The fluid-tight circulation means between each blade 2 and the return circuit 7 comprise a tube 38 passing in sealed manner through the stopper 15 so as to be disposed concentrically inside the bore 30 for the purpose of being connected to the return circuit 7. The tube 38 projects above the stopper 15 by an amount which is sufficient for it to be taken up by a tubular guide 39 integral with a hollow cap 40 made of a conducting metal which is applied in fluid-tight manner against the flange 22 by means of a base 41 and screws 42. The base 41 is extended by a fluid-tight fixing sleeve 43 which is received inside the annular flange 22 and that portion of the ring 9 which extends above the the stopper 15. The cap 40 thus defines a fluid-tight manifold chamber 44 into which the tube 38 opens out.

The fluid-tight flow means between each blade and the circuit 7 further include a substantially radial blind hole 45 formed in the projecting portion of the ring 9 in order to open out into the chamber 44. The hole 45 communicates with an axial hole 46 made in the thickness of the ring 9 in order to communicate with a radial hole 47 coinciding with an opening 48 provided through the corresponding key 26. The opening 48 coincides with a passage 49 formed through the blade root 20 and opening out into the second compartment or channel 2b of the corresponding blade 2.

Sealing means are interposed between the sleeve 43 and the ring 9, between the ring 9 and the key 26, and between the key 26 and the blade root 20.

When a heat-conveying fluid is caused to flow through the circuits 6 and 7, the fluid is delivered into the bore 30, thereby feeding the various channels or compartments 2a of the blade 2 via the ducts 31, the chambers 32 and 34, the holes 35, and the openings 36. The heat-conveying fluid flows in the opposite direction along the channels or compartments 2b after which it flows along the passages 49, the openings 48, the holes 47, 46, and 45 prior to being collected in the chamber 44. The means of the invention enable substantially constant conditions to be maintained in the flow of a heat-conveying fluid used for injecting or removing heat in operation, both via the blades or vanes and via the cap 40.

The means implemented enable go-and-return flows to be set up in fluid-tight manner from a single hub whose structural arrangements are suitable for withstanding the mechanical forces developed either by the rotary drive torque generated by the motor and step-down gear unit 4, or else by the reactions to which the blades 2 are subjected during their work of stirring, mixing, or kneading the composition inside the vat 3.

The invention is not limited to the example described and shown since numerous modifications may be made thereto without going beyond the scope of the invention. In particular, the hub may be designed to establish only one fluid flow passage in communication with the blades, with the blades being provided locally with controlled or uncontrolled orifices for injecting fluid into the mass of substance contained in the vat. In this case, the hub has only one internal circuit constituted either by the bore 30, the ducts 31, the chambers 32 and 34, the openings 33, the holes 35, the openings 36, and the passages 37, or else by the tube 38, the chamber 44, the holes 45, 46, and 47, the openings 48, and the passages 49.

We claim:

1. A hub for an agitator having hollow blades and an internal fluid flow circuit, the hub being of the type intended for mounting at the end of a fluted drive shaft which is connected to at least one fluid flow circuit including a go circuit and a return circuit, the hub comprising:

a fluted ring threaded onto the shaft and carrying the roots of the hollow blades;

an axial fastening liner interposed between the shaft and the ring and locked axially in position by a fluid-tight stopper fitted to the end of the shaft, which shaft delimits an axial bore in communication with the go circuit, said stopper having a tube in communication with the return circuit passing through said stopper and extending above it;

a hollow cap applied to the top of the ring in order to delimit a fluid-tight manifold chamber into which the tube opens out; and fluid-tight fluid flow means passing firstly through the shaft, the liner, the ring, and the blade roots in order to put the blades into communication with the go circuit, and secondly the ring and the blade roots in order to put the blades into communication with the manifold chamber which itself is in communication with the return circuit via the tube.

2. An agitator hub according to claim 1, wherein the fluted ring has a collar at its base defining an under-cut bearing surface which co-operates with complementary reentrant bottom edges of the blade roots in the form of sectors of a ring having a dove-tail shape in axial section, said blade roots being held fast:

axially against the bearing surface by an annular locking flange fixed on the ring and including an under-cut annular rim engaging the top edges of the blade roots;

angularly on the ring by respective keys; and radially by the flange acting in combination with screws engaging in the ring.

3. An agitator hub according to claim 2, wherein the blade roots in the form of sectors of a ring reconstitute a cylindrical envelope housing the ring itself by means of strips interposed between the blade roots.

4. An agitator hub according to claim 2, wherein the complementary reentrant bottom edge of each blade root engages the collar and the under-cut bearing surface defined thereby.

5. An agitator hub according to claim 2 wherein the fluid-tight fluid flow means between the go circuit and each blade comprise:

the axial bore provided along the shaft and closed by the stopper;

a transverse duct opening out into an annular distribution chamber provided between the shaft and the liner;

an opening provided through the liner and opening out into a second annular distribution chamber provided between the liner and the ring;

a radial hole provided through the ring;

an opening provided through the key; and a passage provided through the blade root and opening out into a first channel or compartment therein which is in communication with a second channel.

6. An agitator hub according to claim 5, wherein sealing means are provided at the interfaces between the shaft and the liner, between the linear and the ring, between the ring and the keys, and between the keys and the blade roots.

7. An agitator hub according to claim 2 wherein the fluid-tight fluid flow means between the return circuit and each blade comprise:

the tube disposed in the bore and passing through the stopper to open out into the chamber;

a radial hole passing through the ring and opening out into the chamber;

an axial hole passing through the ring and communicating with the radial hole;

a radial hole going through the ring and communication with said axial hole;

an opening provided through each key; and a passage through each blade root and opening out into a second channel or compartment therein which is in communication with a first channel.

8. An agitator hub according to claim 7, further including a fluid-tight fixing sleeve which is received inside the annular flange and a portion of the ring which extends above the stopper, and wherein sealing means are provided at the interfaces between the sleeve and the ring, between the ring and the keys, and between the keys and the blade roots.

9. An agitator hub according to claim 1, wherein the axial fastening liner is pressed against a shoulder of the ring by a segment of wedge-shaped section under thrust from the stopper.

10. An agitator hub according to claim 1 wherein the cap is fixed to the falnge by means of a cap base which forms a sleeve engaged in fluid-tight manner in a portion of the ring extending beyond the stopper.

* * * * *